US007883177B2

(12) United States Patent
O'Neal

(10) Patent No.: US 7,883,177 B2
(45) Date of Patent: Feb. 8, 2011

(54) TRAY INSERT FOR AN INK TRAY OF A PRODUCTION PRINTING SYSTEM

(75) Inventor: James O'Neal, Lyons, CO (US)

(73) Assignee: Infoprint Solutions Company, LLC, Boulder, CO (US)

( * ) Notice: Subject to any disclaimer, the term of this patent is extended or adjusted under 35 U.S.C. 154(b) by 210 days.

(21) Appl. No.: 12/244,466

(22) Filed: Oct. 2, 2008

(65) Prior Publication Data

US 2010/0085399 A1 Apr. 8, 2010

(51) Int. Cl.
*B41J 2/165* (2006.01)

(52) U.S. Cl. ..... 347/36; 347/31; 347/35

(58) Field of Classification Search ..... 347/24, 347/42, 31, 35, 36
See application file for complete search history.

(56) References Cited

U.S. PATENT DOCUMENTS 3,220,377 A 11/1965 Good
6,312,094 B1 11/2001 Ito et al.
6,663,219 B2 12/2003 Kubota et al.
6,663,220 B2 12/2003 Suzuki et al.
6,834,931 B2 12/2004 Ang et al.
6,886,909 B2 5/2005 Ogasawara
7,296,876 B2 11/2007 Kagami et al.
2006/0081175 A1 4/2006 Nagase
2006/0214981 A1 9/2006 Fukasawa et al.

*Primary Examiner*—shih-wen hsieh
(74) *Attorney, Agent, or Firm*—Duft Bornsen & Fishman, LLP

(57) ABSTRACT

Tray inserts are disclosed for production printing systems. The tray inserts rest in ink trays and hold ink absorbing elements. The tray inserts and ink absorbing elements collect ink when printheads print outside of the margin of a printable medium, or otherwise discharge ink that does not contact the medium, such as during a cleaning cycle. When the ink absorbing elements become saturated and excess ink collects in the tray inserts, the tray inserts may be lifted vertically out of the ink trays and the ink absorbing elements may be removed from the tray inserts. The excess ink may then be dumped or otherwise cleaned from the tray inserts. In one embodiment, the tray inserts include drains which are used to empty the excess ink.

25 Claims, 8 Drawing Sheets

TRAY INSERT FOR AN INK TRAY OF A PRODUCTION PRINTING SYSTEM

BACKGROUND OF THE INVENTION

1. Field of the Invention

The invention relates to the field of production printing systems and, in particular, to a tray insert for an ink tray that is operable to collect ink discharged from printhead arrays in a production printing system.

2. Statement of the Problem

Businesses or other entities having a need for volume printing typically purchase a production printing system. A production printing system comprises a high-speed printer used for volume printing, such as 100 pages per minute or more. The production printing systems are typically continuous-forms printers that print on paper or some other printable medium that is stored on large rolls. Some continuous-forms printers are able to print on paper up to 20 inches wide or more.

A production printing system typically includes a localized print controller that controls the overall operation of the printing system, and one or more print engines (sometimes also referred to as an "imaging engine" or as a "marking engine"). The print engines include a printhead controller and arrays of printheads. An individual printhead includes multiple tiny nozzles (e.g., 360 nozzles per printhead depending on resolution) that are operable to discharge ink as controlled by the printhead controller. The printhead array is formed from multiple printheads that are spaced in series along a particular width, such as 20 inches.

When in operation, the printable medium is passed underneath the printhead arrays while the nozzles of the printheads discharge ink at particular intervals to form pixels on the medium. There are times when the printheads discharge ink outside of the margin of the printable medium. For example, the printing system may run a cleaning cycle which causes each nozzle to discharge ink even when the printable medium is not positioned underneath the printheads. The cleaning cycle is run periodically to avoid clogging of the nozzles. In another example, the printing system may be printing on a medium that is less than the width of the printhead array. For example, a printing system having 20 inch arrays may be printing on an 8.5 inch medium. Instead of shutting off the printheads or nozzles that are not being used to print to the medium and risking that the unused nozzles become clogged, the printheads outside of the margin of the medium are still turned on periodically to avoid clogging. When the printheads discharge ink and there is no printable medium underneath the printheads, the ink being discharged would make an undesirable mess if the ink were not captured in some manner.

Presently, ink trays are affixed or fastened to the printing system opposite the printheads and facing the printheads when they are in a printing position (as opposed to a parked position). The ink trays have a width at least as wide as the printhead arrays, and are open at the top and enclosed at the bottom to act as a container for waste ink that is discharged from the printheads. Typically, a sponge or some other ink absorbing element is placed within the ink tray to absorb the ink being discharged by the printheads.

After the printing system has been in operation for a time period, the ink absorbing elements in the ink trays will become saturated with ink. The printer operator will then remove the ink absorbing elements from the ink trays, and discard the ink absorbing elements. In many cases, there will be excess ink in the bottom of the ink trays which the ink absorbing elements were unable to absorb. Thus, the printer operator will additionally have to clean the ink trays while they are attached to the printing system, or remove the ink trays from the printing system for cleaning. Ink trays are affixed or fastened to the printing system in a rigid but removable fashion. For example, ink trays in some printing systems are bolted to frame of the printing system on either one end or both ends. Thus, to remove the ink trays, the printer operator has to remove the bolts, screws, or another fastening member from the ink trays, and then attempt to remove the ink trays from the printing system. Removal of the ink trays may then require sliding, twisting, or otherwise manipulating the position of the ink trays in order to detach it from the frame, and extricate it from the printing system.

One problem with the present ink tray configuration is that it can be messy to change the ink absorbing elements in the ink trays, and to remove the ink trays from the printing system in order to remove excess ink from the trays. Because the ink absorbing elements are saturated with ink, the ink may drip into the bottom of the printing system and onto the floor when they are lifted out of the ink trays. Also, when the printer operator attempts to detach the ink trays from the printing system, the excess ink that is being contained in the ink trays may spill into the printing system or onto the floor.

SUMMARY OF THE INVENTION

Embodiments of the present invention solve the above and other related problems with tray inserts for the ink trays. In one embodiment, the tray inserts rest inside of the ink trays, and hold ink absorbing elements, such as sponges. When the ink absorbing elements become saturated, the tray insert may be lifted out of the ink tray and transported to a sink or waste receptacle. The ink absorbing element may then be removed from the tray insert and discarded. If excess ink remains in the bottom of the tray insert, then the excess ink may be dumped or otherwise cleaned from the tray insert. With the excess ink removed, a new ink absorbing element may be inserted in the tray insert, and the tray insert may again be placed in the ink tray.

By using tray inserts in the ink trays, the tray inserts may be lifted vertically from the ink trays and carried to a location where the ink absorbing elements can be removed from the ink trays. This advantageously avoids ink spills inside of the printing system. Also, the ink trays do not need to be detached from the printing system to remove excess ink. Instead, the tray inserts containing the excess ink may simply be lifted from the ink trays without detaching the ink trays. Thus, the tray inserts may be cleaned outside of the printing system, which advantageously avoids the mess commonly resulting from removing the ink trays.

In another embodiment, the tray insert includes a drain on its bottom section. A drain tube may be connected between the drain and an ink storage container so that the excess ink may be emptied from the tray insert through the drain while the printing system is operating. The invention may include other exemplary embodiments described below.

DESCRIPTION OF THE DRAWINGS

The same reference number represents the same element or same type of element on all drawings.

DETAILED DESCRIPTION

FIGS. 1-8 and the following description depict specific exemplary embodiments of the present invention to teach those skilled in the art how to make and use the invention. For the purpose of this teaching, some conventional aspects of the invention have been simplified or omitted. Those skilled in the art will appreciate variations from these embodiments that fall within the scope of the present invention. Those skilled in the art will appreciate that the features described below can be combined in various ways to form multiple variations of the present invention. As a result, the invention is not limited to the specific embodiments described below, but only by the claims and their equivalents.

Figure 1:
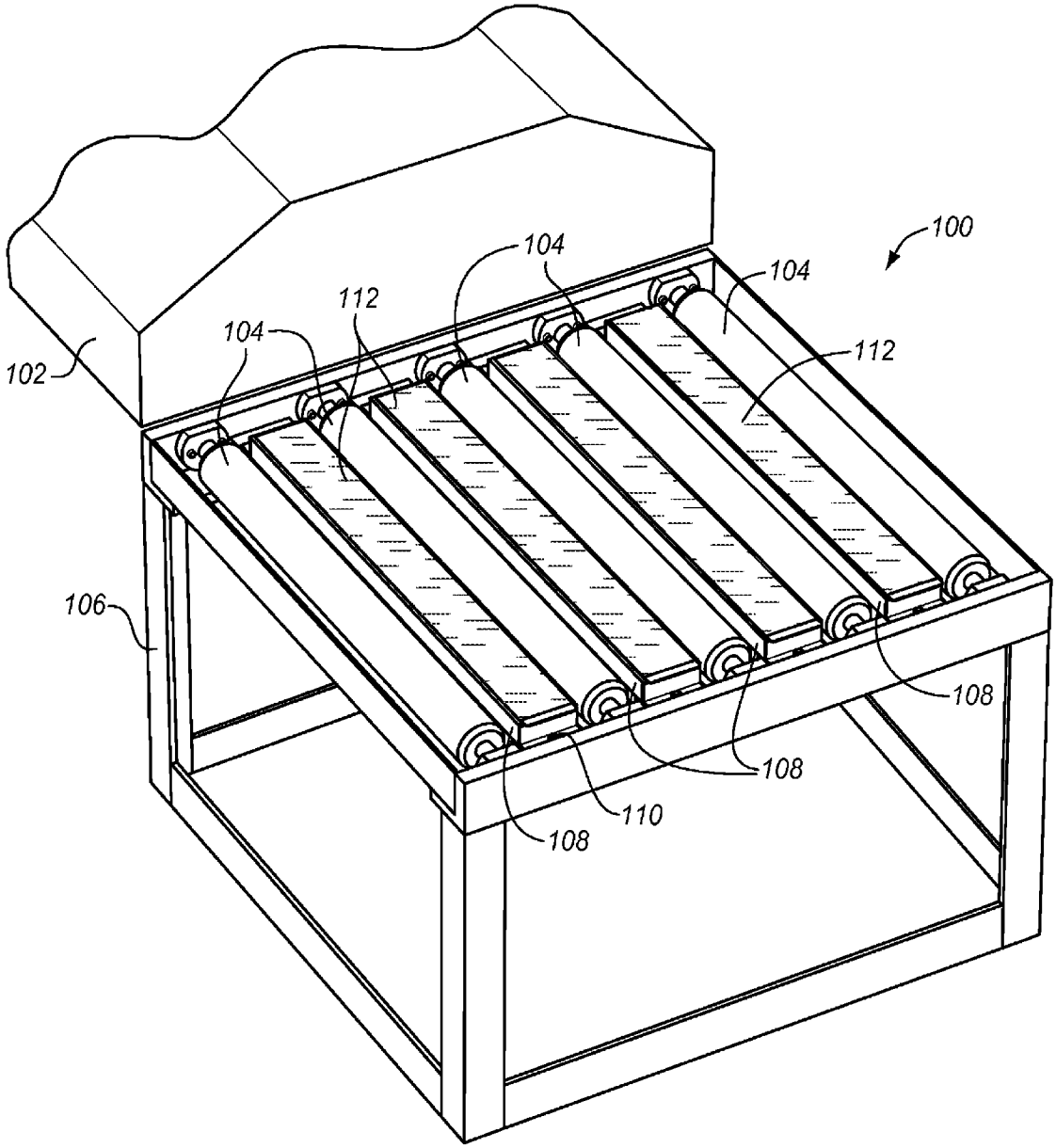
FIG. 1 is an isometric view of a production printing system.

FIG. 1 is an isometric view of a production printing system 100. Printing system 100 comprises any system used to provide marks on a media, such as a continuous forms printer or a cut sheet page printer. In this embodiment, printing system 100 comprises a production printing system that is a high-speed printer used for volume printing, such as 100 pages per minute or more.

In this embodiment, printing system 100 includes one or more printhead arrays that are located underneath hood 102. The printhead arrays are in a parked position in FIG. 1. The printing station includes a plurality of rollers 104 that support one surface of a printable medium (i.e., a bottom surface) as the medium is passed underneath the printhead arrays to allow the printheads to print on the opposite surface of the medium (i.e., the top surface). For example, the printable medium may pass over rollers 104 from right to left in FIG. 1.

Printing system 100 also includes a plurality of ink trays 108 that are located proximate to rollers 104. For example, the ink trays 108 may be located in between rollers 104 as shown in FIG. 1. Ink absorbing elements 112, such as a sponge, are placed in ink trays 108. Each of the ink trays 108 are affixed or fastened to the frame 106 of printing system 100 by fastening members 110. Fastening members 110 may comprise bolts, screws, etc. Ink trays 108 have a width at least as wide as the printhead arrays (i.e., slightly larger). For example, if the width of the printhead arrays is 20 inches, then the width of ink trays 108 is approximately 20 inches.

Figure 2:
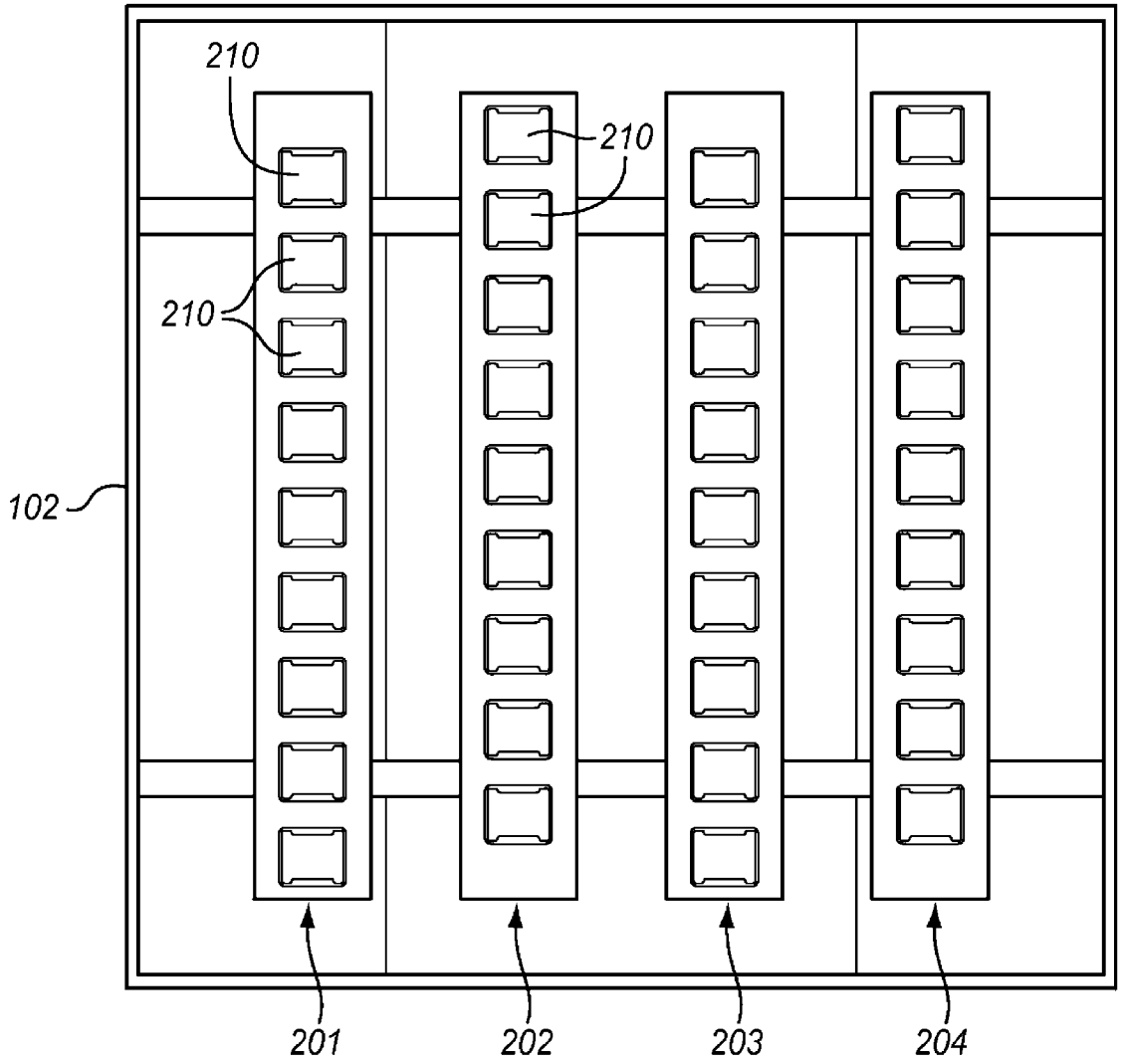
FIG. 2 illustrates a plurality of printhead arrays.

FIG. 2 illustrates a plurality of printhead arrays 201-204. Printhead arrays 201-204 are implemented underneath hood 102 as shown in FIG. 1 to be facing downward. Each printhead array 201-204 is comprised of a plurality of printheads 210. Each individual printhead 210 includes multiple tiny nozzles (e.g., 360 nozzles per printhead depending on resolution) that are operable to discharge ink.

Figure 3:
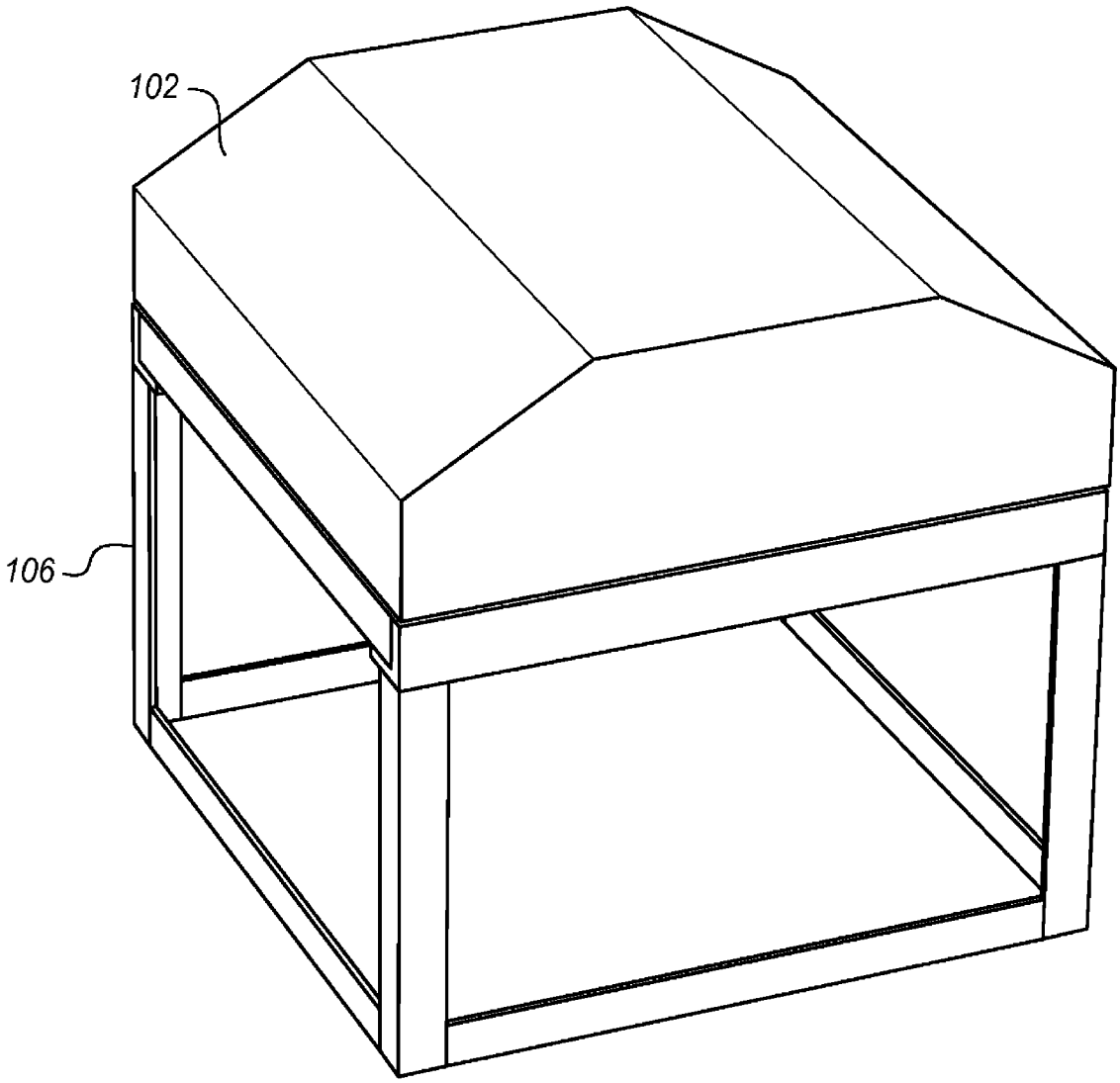
FIG. 3 is an isometric view of a production printing system illustrating printhead arrays moved to a printing position.
Figure 4:
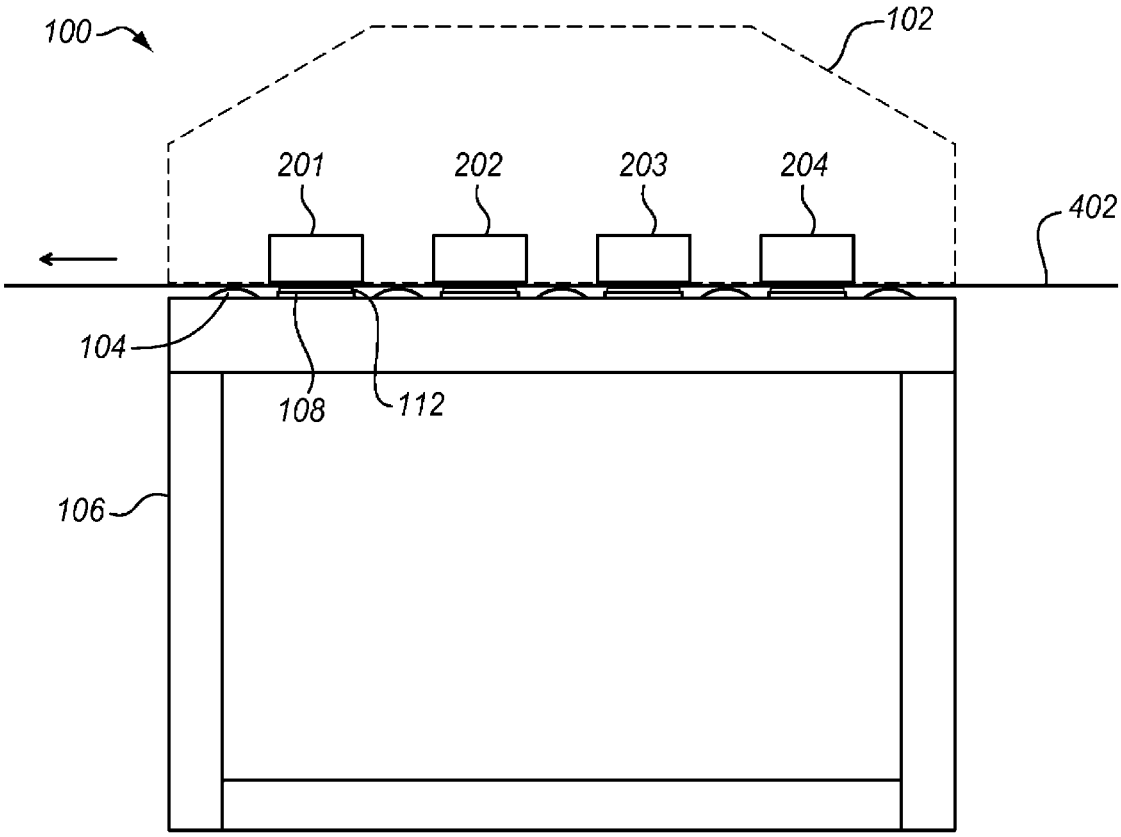
FIG. 4 is a side view of a production printing system illustrating printhead arrays in a printing position.

When a print job is sent to printing system 100, the printhead arrays 201-204 are moved from the parked position to a printing position. FIG. 3 is an isometric view of printing system 100 illustrating the printhead arrays 201-204 (not shown but under hood 102) moved to the printing position. With the printhead arrays 201-204 moved to the printing position, a printable medium (i.e., paper) may be passed over top of rollers 104 and underneath the printhead arrays 201-204. FIG. 4 is a side view of printing system 100 illustrating the printhead arrays 201-204 in the printing position. To print the print job, printable medium 402 is passed (from right to left) over top of rollers and underneath printhead arrays 201-204. While the printable medium 402 is moving underneath printhead arrays 201-204, the printhead arrays 201-204 discharge ink on the medium 402 to image the print job on medium 402.

Figure 5:
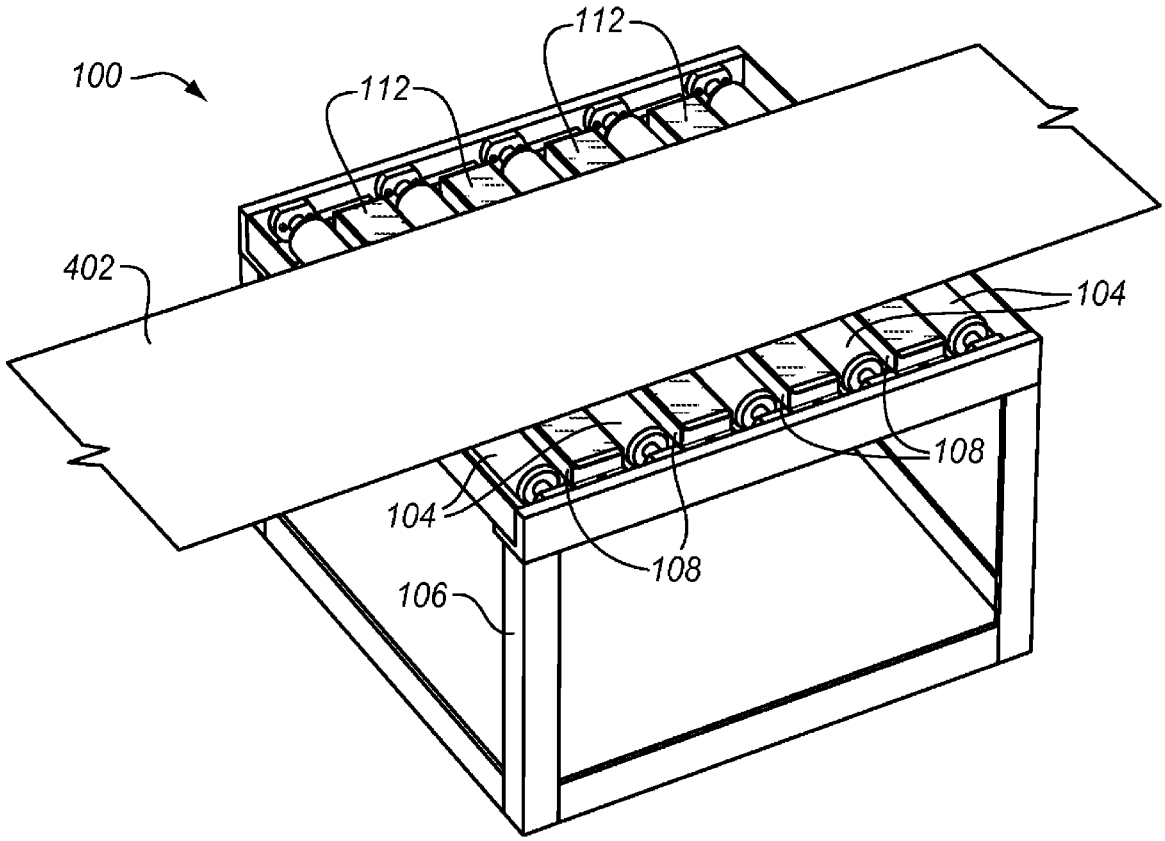
FIG. 5 is an isometric view of a production printing system illustrating a printable medium passing over rollers.

There may be instances when printing system 100 is printing on a medium 402 that is not as wide as printhead arrays 201-204. For example, printing system 100 may be printing on 8.5 inch paper even though the printhead arrays 201-204 are 20 inches wide. FIG. 5 is an isometric view of printing system 100 illustrating a printable medium 402 passing over rollers 104. Printhead arrays 201-204 are not shown in FIG. 5, but have a similar width as ink trays 108. It is evident in FIG. 5 that the width of printable medium 402 is not as wide as the printhead arrays 201-204. Instead of shutting off the printheads 210 or nozzles that are not being used to print to medium 402 and risking that the unused nozzles become clogged, the printheads 210 that are not being used to print for this print job are still turned on periodically to avoid clogging. This means that printhead arrays 201-204 may discharge outside of the margins of medium 402. Ink trays 108 are adapted to collect the ink that is discharged outside of the margins.

There may also be instances where printing system 100 runs a cleaning cycle which causes printhead arrays 201-204 to discharge ink from each nozzle. Ink trays 108 are also adapted to collect ink that is discharged during the cleaning cycle.

As is illustrated in FIG. 4, ink trays 108 are located opposite printhead arrays 201-204 and facing printhead arrays printhead arrays 201-204. Ink trays 108 are also at least as wide as printhead arrays 201-204 so that ink trays 108 may collect any ink discharged from printhead arrays 201-204 that does not contact medium 402.

Figure 6:
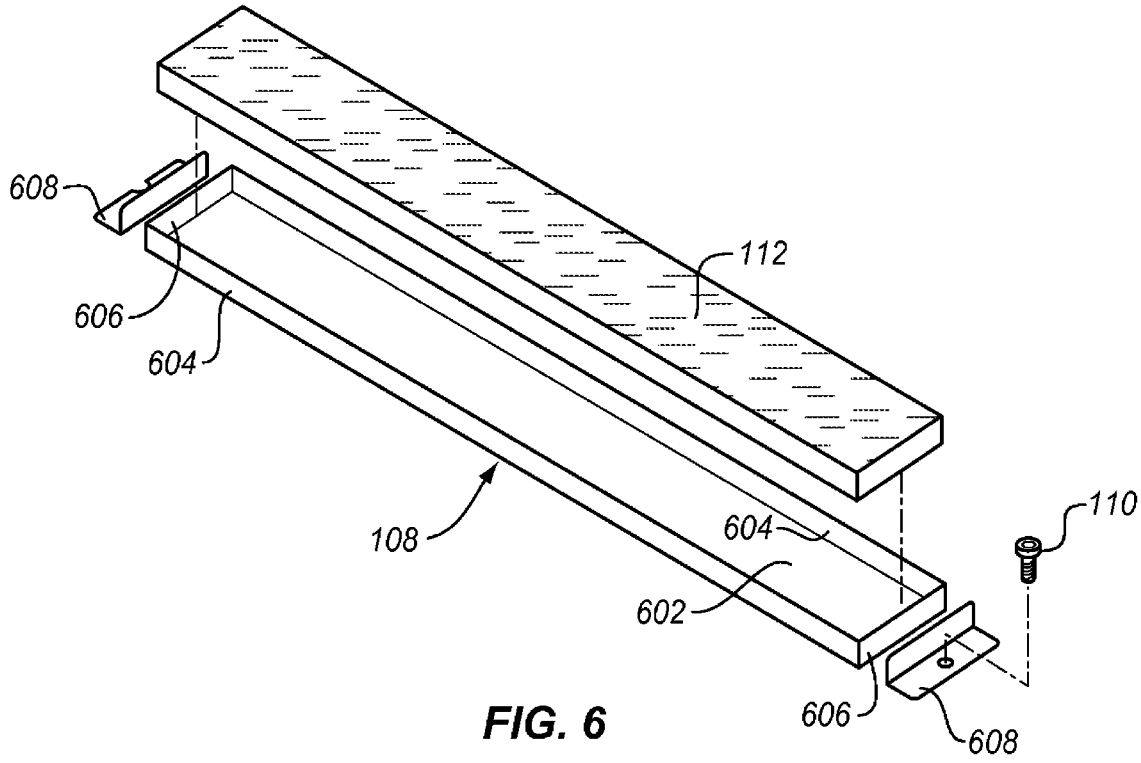
FIG. 6 PRIOR ART
FIG. 6 is an isometric view of an ink tray in the prior art.

FIG. 6 is an isometric view of an ink tray 108 in the prior art. Ink tray 108 has a substantially flat bottom section 602, and includes two side sections 604 and two end sections 606 that extend perpendicularly from bottom section 602. The bottom section 602, two side sections 604, and two end sections 606 are welded or otherwise connected to one another in a sealed fashion to form a container structure that is open at the top and enclosed at the bottom to contain a liquid. Ink absorbing element 112 is able to rest on the bottom section 602 of ink tray 108 to absorb ink discharged from the printheads. The container structure of ink tray 108 allows ink tray 108 to contain excess ink that is not absorbed by ink absorbing element 112.

Ink tray 108 also includes connecting members 608 affixed to each end section 606. Connecting members 608 are used to fasten ink tray 108 to the frame 106 of printing system 100 (see FIG. 1) in a rigid but removable fashion. As illustrated in FIG. 6, the leftmost connecting member 608 is adapted to mate with a corresponding connecting member (not shown) on frame 106 to secure ink tray 108 to frame 106. The rightmost connecting member 608 is adapted to fasten to frame 106 through fastening member 110.

As stated in the Background, when printing system 100 has been in operation for a time period, the ink absorbing elements 112 in ink trays 108 will become saturated with ink. When the ink absorbing elements 112 become saturated, the printer operator will stop the printing process and remove the ink absorbing elements 112 from ink trays 108. Unfortunately, it may be messy to remove the ink absorbing elements 112 from the ink trays 108. Because the ink absorbing elements 112 are saturated with ink, the ink may drip into the bottom of printing system 100 and onto the floor when they are lifted out of ink trays 108.

Additionally, there will be excess ink in the bottom of ink trays 108 which the ink absorbing elements 112 were unable to absorb. Thus, the printer operator has to clean this excess ink from the ink trays 108. To do so, the printer operator will have to clean the ink trays 108 while the ink trays 108 are fastened to printing system 100, or remove the ink trays 108. To remove ink trays 108 as illustrated in FIGS. 1 and 6, the printer operator will remove the fastening member 110 that attaches one of the connecting members 608 to frame 106. Removal of ink trays 108 may then require sliding, twisting, or otherwise manipulating the position of ink trays 108 in order to detach the other connecting member 608 from frame 106.

Unfortunately, additional ink spills may result from removing ink trays 108 that are mounted on printing system 100. For example, after fastening member 110 is removed, the printer operator may need to twist or turn ink tray 108, lift one end of ink tray 108, or otherwise manipulate ink tray 108 in order to detach it from frame 106. When the printer operator handles ink tray 108 in this fashion, the excess ink that is being contained in ink tray 108 may spill into printing system 100 or onto the floor.

To avoid this problem, a removable tray insert is implemented in ink trays 108 in exemplary embodiments of the invention. Thus, instead of having ink trays 108 hold the ink absorbing elements 112 and containing excess ink, such as in FIG. 6, removable tray inserts are used in ink trays 108 to both hold the ink absorbing elements 112 and contain the excess ink, as is further illustrated in FIG. 7.

Figure 7:
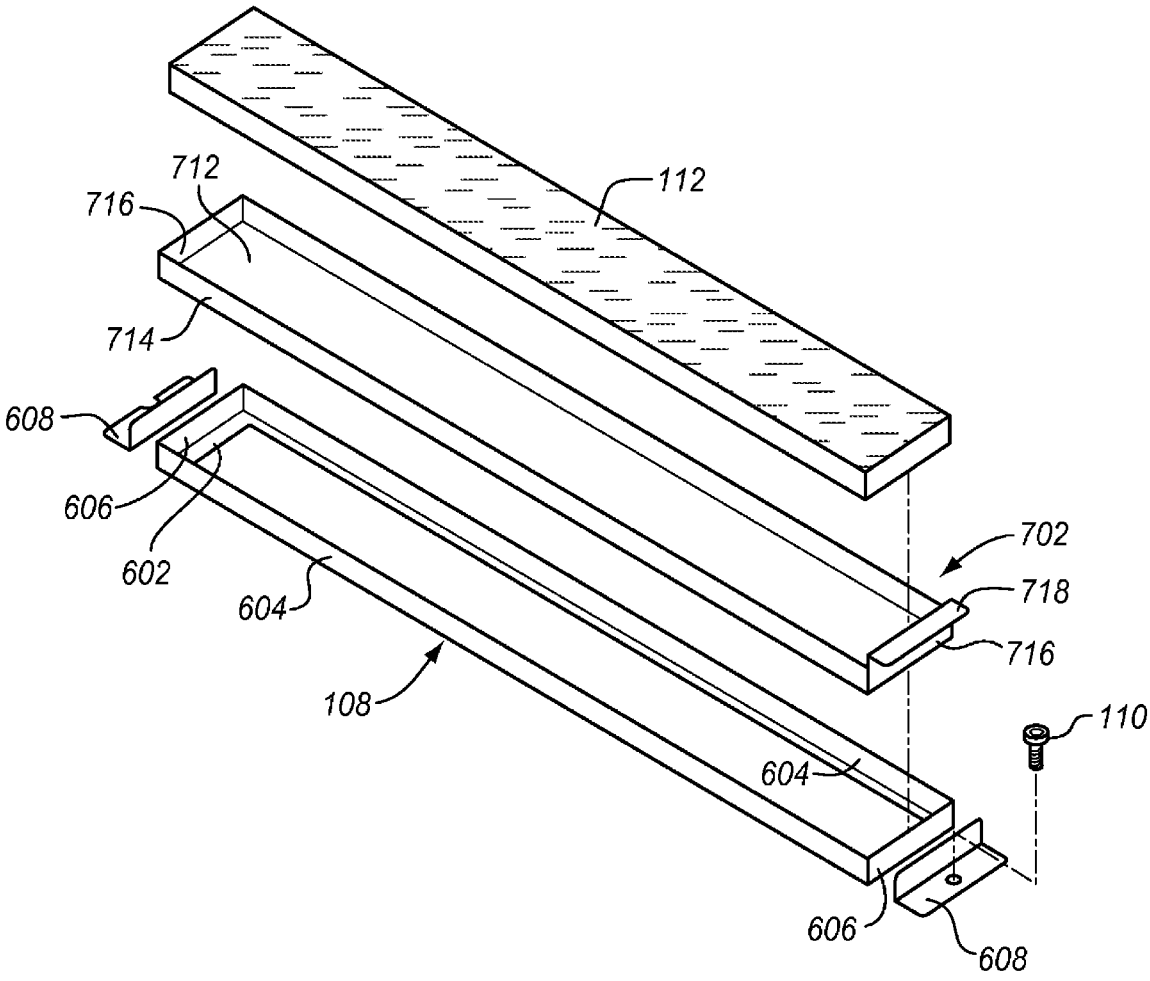
FIG. 7 is an isometric view of a tray insert in an exemplary embodiment of the invention.

FIG. 7 is an isometric view of a tray insert 702 in an exemplary embodiment of the invention. In the embodiment in FIG. 7, the bottom section 602 of ink tray 108 is substantially open except for a thin border that is used to support tray insert 702. Although ink tray 108 is illustrated as having an open bottom section in this embodiment, ink tray 108 may have any desired structure that is able to support a tray insert 702, such as a container structure illustrated in FIG. 6.

Tray insert 702 includes a bottom section 712, two side sections 714, and two end sections 716 that are connected to one another in a sealed fashion to form a container structure that is open at the top and enclosed at the bottom to contain a liquid, such as ink. Tray insert 702 has outer dimensions that are slightly less than the inner dimensions of ink tray 108 so that tray insert 702 is able to rest in or on ink tray 108. Tray insert 702 has a width (i.e., the dimension of the major plane) at least as wide (i.e., slightly larger) as the printhead arrays 201-204 in printing system 100 in order to collect the ink that is discharged from the printheads 210. For example, if the width of the printhead arrays 201-204 is 20 inches, then the width of tray inserts 702 is approximately 20.5 inches.

Tray insert 702 fits in or on ink tray 108 in a removable fashion so that it may be lifted from ink tray 108 to remove ink absorbing element 112 from printing system 100. Tray insert 702 is not rigidly affixed or fastened to ink tray 108. In other words, tray insert 702 is not bolted or otherwise affixed to printing system 100 or ink tray 108. Thus, tray insert 702 is easily removed from ink tray 108 by simply lifting tray insert 702 from ink tray 108. To assist in lifting tray insert 702 from ink tray 108, tray insert 702 may have a lip 718 on one end section 716 to allow the printer operator to grasp the tray insert 702 and lift tray insert 702 out of ink tray 108. Although a lip 718 is illustrated in FIG. 7, tray insert 702 may include some type of handle or other lifting member which allows the printer operator to grasp the tray insert 702 and lift tray insert 702 out of ink tray 108. Tray insert 702 may be formed from plastic or some other material that is relatively light-weight so that the printer operator can easily lift tray insert 702 from ink tray 108.

Tray insert 702 is open at the top to receive ink absorbing element 112. Ink absorbing element 112 spans the width of tray insert 702 to absorb the ink discharged outside of the margins (i.e., ink that does not contact the printable medium). Because tray insert 702 is enclosed at the bottom to form a container structure, tray insert 702 is able to contain excess ink that is not absorbed by ink absorbing element 112. The inner dimensions of tray insert 702 may be approximately the dimensions of ink absorbing element 112 in order to hold ink absorbing element 112. Alternatively, the inner dimensions of tray insert 702 may be deeper than the dimensions of ink absorbing element 112 and tapered toward the bottom so that excess ink pooling in the bottom of tray insert 702 does not necessarily contact ink absorbing element 112.

When printing system 100 has been in operation for a time period, the ink absorbing elements 112 in tray inserts 702 may become saturated with ink. The printer operator will then lift the tray inserts 702 out of ink trays 108. The printer operator may then transport the tray insert to a sink or waste receptacle and remove the ink absorbing elements 112 from tray inserts 702. If any excess ink remains in the bottom of tray inserts 702, then the printer operator may dump out the ink or otherwise clean the ink from tray inserts 702. The printer operator may then place new ink absorbing elements 112 in tray inserts 702, and replace the tray inserts 702 in ink trays 108.

By using tray inserts 702 in ink trays 108, the tray inserts 702 may be lifted vertically from ink trays 108 and transported to a location where the ink absorbing elements 112 can be removed from the ink trays 108. This advantageously avoids ink spills inside of printing system 100. Also, the ink trays 108 do not need to be detached from printing system 100 to remove excess ink. Instead, tray inserts 702 containing the excess ink may simply be lifted from the ink trays 108 without detaching the ink trays 108. Thus, the tray inserts 702 may be cleaned outside of printing system 100, which advantageously avoids the mess commonly resulting from removing the ink trays 108.

Figure 8:
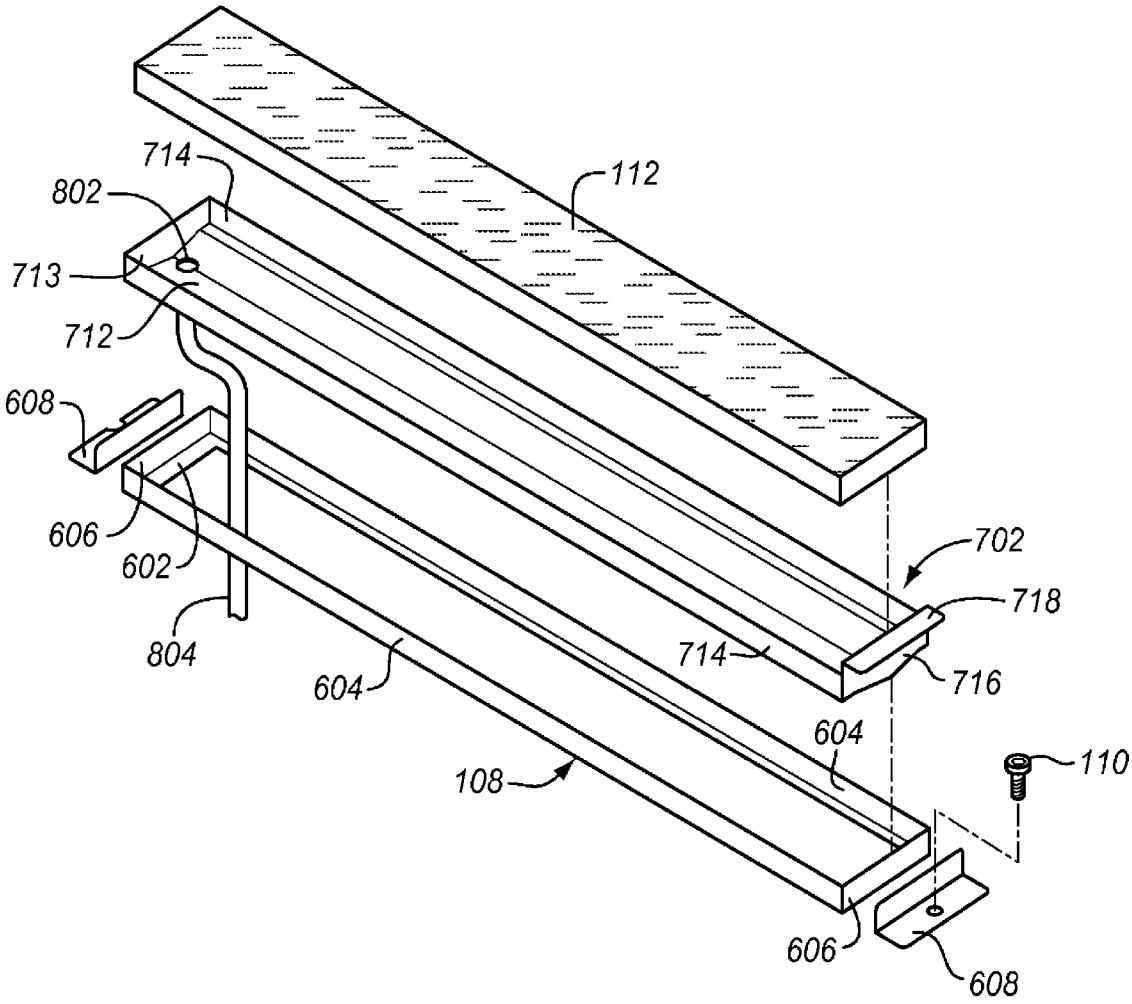
FIG. 8 is an isometric view of a tray insert with a drain in another exemplary embodiment of the invention.

FIG. 8 is an isometric view of a tray insert 702 with a drain in another exemplary embodiment of the invention. In this embodiment, bottom section 712 of tray insert 702 includes a drain 802. Drain 802 comprises some type of opening that allows ink to empty from tray insert 702 while tray insert 702 is resting in ink tray 108. Although drain 802 is illustrated on one end of tray insert 702, those skilled in the art will appreciate that drain 802 may be fabricated in different locations of bottom section 712. Also, although drain 802 is illustrated on bottom section 712, drain 802 may be fabricated on one of the side sections 714 proximate to the bottom section 712 in other embodiments.

In order to influence the flow of ink toward drain 802, bottom section 712 may slope toward the location of drain 802. For example, bottom section 712 may have an angled shape as shown in FIG. 8 where the outer portions of bottom section 712 are raised in relation to the center portion so that overall shape of bottom section 712 slopes toward the center portion. Drain 802 may then be fabricated at or near the center portion. Alternatively, bottom section 712 may have a concave or bowl shape, with drain 802 fabricated at or near the bottom of the bowl.

Drain 802 may be fabricated toward one end of bottom section 712 as illustrated in FIG. 8, or may be fabricated toward the center of bottom section 712. If drain 802 is fabricated toward one end, then bottom section 712 may have a shape that slopes toward the end having drain 802. If drain 802 is fabricated toward the center, then bottom section 712 may have a shape so that both ends slope toward the center.

Drain 802 is able to empty excess ink that pools in the bottom of tray insert 702. To empty the excess ink, a drain tube 804 may be connected between drain 802 and an ink storage container (not shown). As printing system 100 is in operation, drain 802 may empty the excess ink in tray insert 702 so that ink absorbing elements 112 will not become saturated as quickly. Thus, printing system 100 may operate for a longer time period before the ink absorbing elements 112 have to be changed. If the printer operator determines that the ink absorbing elements 112 have become saturated, then tray inserts 702 may be removed as described above and the ink absorbing elements 112 may be replaced.

Although specific embodiments were described herein, the scope of the invention is not limited to those specific embodiments. The scope of the invention is defined by the following claims and any equivalents thereof.

I claim:

1. A production printing system, comprising:

a printhead array operable to discharge ink to print on a printable medium;

an ink tray that is affixed in the printing system facing the printhead array;

a tray insert adapted to rest in the ink tray and to be lifted from the ink tray; and an ink absorbing element adapted to rest in the tray insert and operable to absorb ink that is discharged from the printhead array when the ink does not contact the printable medium;

wherein the tray insert includes a bottom section, two side sections, and two end sections that are connected to one another in a sealed fashion to form a container structure that is open at the top and enclosed at the bottom to contain a liquid;

wherein the tray insert further includes a drain on the bottom section, where the bottom section of the tray insert slopes toward the drain.

2. The production printing system of claim 1 wherein the tray insert has a width at least as wide as the printhead array.

3. The production printing system of claim 1 wherein the tray insert further includes:

a lip on one of the end sections that is adapted to be grasped by a printer operator to lift the tray insert vertically from the ink tray.

4. The production printing system of claim 1 further comprising:

a drain tube that connects between the drain and an ink storage container.

5. A production printing system having a printhead array operable to discharge ink and having an ink tray that is affixed in the printing system to face the printhead array, the production printing system comprising:

a tray insert that fits in the ink tray and has a container structure having a bottom section, two side sections, and two end sections that are connected to one another in a sealed fashion, the container structure is open at the top to receive an ink absorbing element operable to absorb ink that is discharged from the printhead array outside of the margin of the printable medium, and is enclosed at the bottom to contain a liquid;

wherein the tray insert further includes a drain on the bottom section, where the bottom section of the tray insert slopes toward the drain;

wherein the tray insert is adapted to be lifted from the ink tray to remove the ink absorbing element from the printing system.

6. The production printing system of claim 5 wherein the tray insert has a width at least as wide as the printhead array.

7. The production printing system of claim 5 wherein the tray insert further includes:

a lip on one of the end sections that is adapted to be grasped by a printer operator to lift the tray insert vertically from the ink tray.

8. The production printing system of claim 5 further comprising:

a drain tube that connects between the drain and an ink storage container.

9. A production printing system, comprising:

a plurality of rollers operable to support a first surface of a printable medium;

a plurality of printhead arrays operable to discharge ink to print on a second surface of the printable medium;

a plurality of ink trays that are affixed in the printing system proximate to the rollers and facing the printhead arrays;

a plurality of tray inserts each adapted to rest in one of the ink trays and to be lifted from the ink trays; and a plurality of ink absorbing elements each adapted to rest in one of the tray inserts and operable to absorb ink that is discharged from the printhead arrays outside of the margin of the printable medium.

10. The production printing system of claim 9 wherein the tray inserts have a width at least as wide as the printhead arrays.

11. The production printing system of claim 9 wherein each of the tray inserts include:

a bottom section, two side sections, and two end sections that are connected to one another in a sealed fashion to form a container structure that is open at the top and enclosed at the bottom to contain a liquid.

12. The production printing system of claim 11 wherein each of the tray inserts further include:

a lip on one of the end sections that is adapted to be grasped by a printer operator to lift the tray insert vertically from the ink tray.

13. The production printing system of claim 11 wherein each of the tray inserts further includes:

a drain on the bottom section.

14. The production printing system of claim 13 wherein the bottom section of each of the tray inserts slopes toward the drain.

15. The production printing system of claim 13 further comprising:

a plurality of drain tubes that connect between the drains and an ink storage container.

16. A production printing system, comprising:

a printhead array operable to discharge ink to print on a printable medium;

an ink tray that is affixed in the printing system facing the printhead array;

a tray insert adapted to rest in the ink tray; and an ink absorbing element adapted to rest in the tray insert and operable to absorb ink that is discharged from the printhead array when the ink does not contact the printable medium;

wherein the tray insert includes a drain;

wherein the tray insert has a width corresponding with the width of the printhead array.

17. The production printing system of claim 16 further comprising:

a drain tube that connects between the drain and an ink storage container.

18. The production printing system of claim 16 wherein the tray insert includes:

a bottom section, two side sections, and two end sections that are connected to one another in a sealed fashion to form a container structure;

wherein the drain is fabricated on the bottom section.

19. The production printing system of claim 18 wherein the bottom section of the tray insert slopes toward the drain.

20. The production printing system of claim 18 wherein the tray insert further includes:

a lip on one of the end sections that is adapted to be grasped by a printer operator to lift the tray insert vertically from the ink tray.

21. A production printing system having a printhead array operable to discharge ink and having an ink tray that is affixed in the printing system facing the printhead array, the production printing system comprising:

a tray insert that fits in the ink tray and has a container structure that is open at the top to receive an ink absorbing element operable to absorb ink that is discharged from the printhead array outside of the margin of the printable medium, and is enclosed at the bottom to contain a liquid;

the tray insert further including a drain proximate to a bottom section of the container structure;

wherein the tray insert has a width at least as wide as the printhead array.

22. The production printing system of claim 21 wherein the bottom section of the tray insert slopes toward the drain.

23. The production printing system of claim 21 further comprising:

a drain tube that connects between the drain and an ink storage container.

24. The production printing system of claim 21 wherein the tray insert includes:

the bottom section, two side sections, and two end sections that are connected to one another in a sealed fashion to form the container structure;

wherein the drain is fabricated on the bottom section.

25. The production printing system of claim 24 wherein the tray insert further includes:

a lip on one of the end sections that is adapted to be grasped by a printer operator to lift the tray insert vertically from the ink tray.

* * * * *